United States Patent [19]

Estrada

[11] Patent Number: 4,832,337

[45] Date of Patent: May 23, 1989

[54] PINATA GAME

[76] Inventor: Luis I. Estrada, 4462 SW. 10 St., Miami, Fla. 33134

[21] Appl. No.: 77,448

[22] Filed: Jul. 24, 1987

[51] Int. Cl.[4] ..... A63F 9/00

[52] U.S. Cl. ..... 273/1 GF; 434/259; 446/5

[58] Field of Search ..... 273/1 G, 1 GF, 1 GG, 273/1 L; 434/259; 446/5

[56] References Cited

U.S. PATENT DOCUMENTS

| | | | |
|---|---|---|---|
| 1,103,369 | 7/1914 | Montessori | 434/259 X |
| 2,659,163 | 11/1953 | Albee | 434/259 X |
| 3,280,499 | 10/1966 | Studen | 434/259 X |
| 3,471,149 | 10/1969 | Glass et al. | 273/1 GF |
| 3,857,569 | 12/1974 | Goldfarb et al. | 273/1 GG X |
| 4,092,798 | 6/1978 | Oquita | 446/5 |
| 4,118,027 | 10/1978 | Cody | 273/1 L |
| 4,167,078 | 9/1979 | Oquita | 446/5 |
| 4,349,197 | 9/1982 | Livick | 434/259 X |

*Primary Examiner*—Paul E. Shapiro
*Attorney, Agent, or Firm*—J. Sanchelima

[57] ABSTRACT

A reusable pinata for dispensing tokens or object that have a predetermined configuration to fit cavities in boards. The objects are dispensed when strings are pulled that open the closure members that are pivotally mounted to the bottom of a hollow container. The container is suspended from a stand assembly that includes a base, an upwardly extending pole member and an arm member that is substantially perpendicular to the pole member. A timer is mounted to the pole member.

5 Claims, 2 Drawing Sheets

PINATA GAME

BACKGROUND OF THE INVENTION

1. Field of the Invention

The present invention relates to pinata games, and more particularly, to those pinata games that are reusable.

2. Description of the Related Art

Pinata designs usually include a container that is filled with candy bars and toys. The Mexican pinatas are typically hit by one of the children playing the game and the Cuban pinata involve the pulling of ribbons to make an opening through the bottom of a container. Both of these pinata designs involve the destruction of the pinata.

SUMMARY OF THE INVENTION

It is one of the main objects of the present invention to provide a reusable pinata game that can be utilized several times.

It is another object of this present invention to provide such a pinata game that is educational requiring the participating children to recognize the shapes of tokens dropped by the pinata and encourages them to do this within given time parameters.

It is yet another object of this present invention to provide such a game that is inexpensive to manufacture and reuse while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
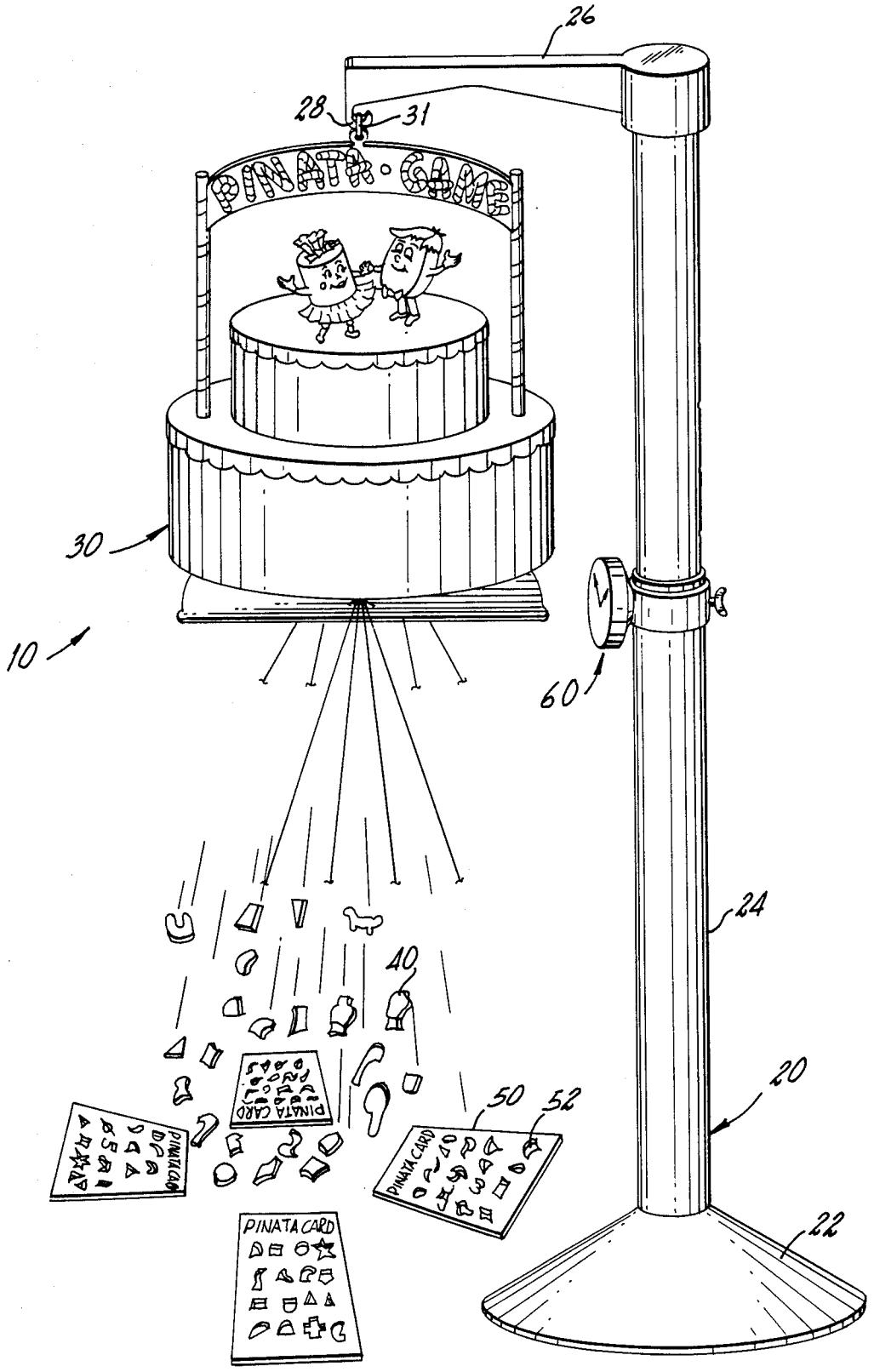
FIG. 1 represents a view in perspective of the present invention after the strings are pulled showing the different tokens being dropped by the pinata.
Figure 2:
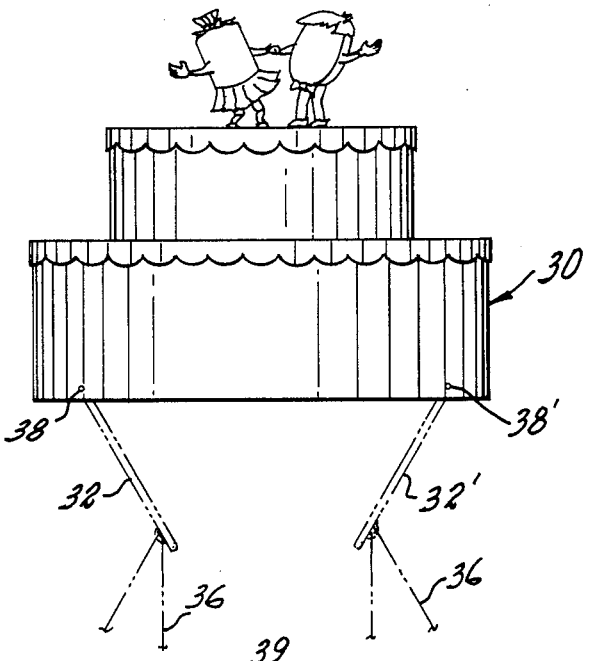
FIG. 2 shows an elevational view of the container.
Figure 3:
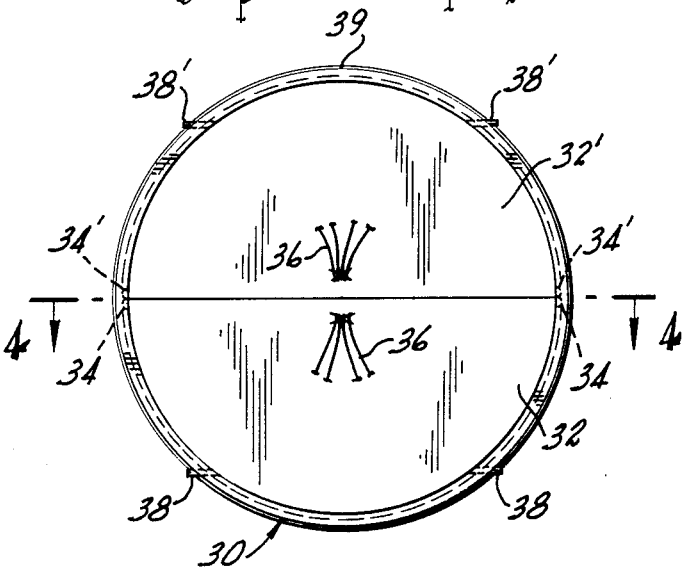
FIG. 3 illustrates a bottom view of the container.
Figure 4:
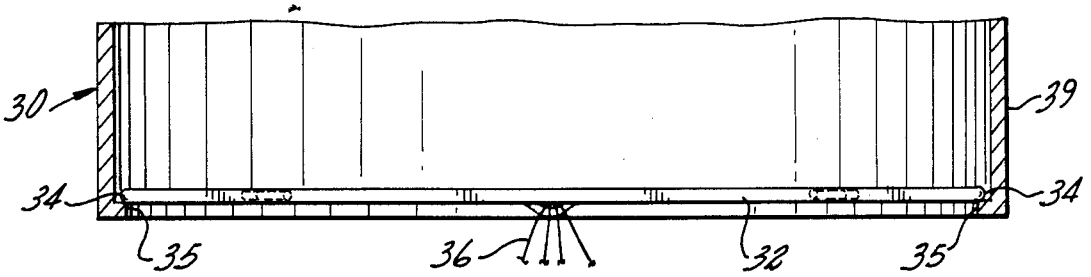
FIG. 4 is a representation of a view taken along line 4—4 in FIG. 3.

Referring now to FIG. 1, where the present invention is generally referred to with numeral 10, it can be observed that it basically includes adjustable height stand assembly 20, hollow container member 30, game objects 40, game boards 50 and timer 60 mounted preferably on assembly 20.

Stand assembly 20 comprises base member 22 having a sufficiently large footprint to provide the necessary stability to the structure which extends upwardly and horizontally with pole member 24 and arm member 26. Hook member 28 is located preferably at the outer end of arm member 26 to provide suitable means for supporting container 30 through loop 31. Container 30 is hollow and it is suspended from the end of arm 26. The outer surface is designed with an attractive ornamental shape and look. Container 30 includes an opening in the bottom where two closure members 32 and 32' are pivotally mounted. Closure members 32 and 32' are releasably latched in the closed position when in the horizontal plane. Latching tab members 34 and 34', in the preferred embodiment, provide a simple means for releasably holding closure members 32 and 32' in a horizontal plane. Latching tab members 34 and 34' rest on inwardly extending flange 35. Closure members 32 and 32', as well as integrally built latching tab members 34 and 34' are made of a resilient material that allows for certain deformation when strings 36 are pulled thereby exerting a downward force on closure members 32 and 32'. The deformation is sufficient to cause a deflection on closure members 32 and 32' allowing tab members 34 and 34' to slip down. Closure members 32 and 32' are pivotally mounted to lateral wall 39 of container 30 through pins 38 and 38'.

A number of tokens or objects 40, with a variety of shapes, are loaded into container 30. When they are dispensed, as the result of the children pulling strings 36, they fall so that they can be picked up by the players and matched with the cavities or apertures 52 in boards 50. A timer 60 is mounted to pole member 24, preferably, so that the players can be timed, if desired.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. An educational game for children comprising:

(a) a stand;

(b) a hollow container suspended from said stand;

(c) an opening in the bottom of said hollow container;

(d) a closure member pivotally mounted within said opening, said closure member being movable between a horizontal position closing said opening and a vertical position opening said opening;

(e) means for releasably latching said closure member in its horizontal position closing said opening;

(f) means for releasing said latching means to permit said closure member to pivot from its horizontal to its vertical position;

(g) a plurality of game objects of different sizes and shapes having means to divide said objects into different distinguishable sets;

(h) a plurality of distinguishable game boards, each having means to associate that game board with one of the sets and having apertures therein of the same size and shape as the game objects of the associated sets; and (i) means for timing the game; whereby each game player may take a game board, the game pieces may be placed in the container, the closure may be closed and subsequently released thereby freeing the game objects to fall therefrom, and the players may race against the timer and each other to place the associated game objects into the matching recesses of their game boards.

2. The game set forth in claim 1 further including:

(j) a plurality of strings attached on one end to said closure member and the other end being free so that the players may pull from said string members to release said closure member.

3. The game set forth in claim 2 wherein said closure member includes at least one latching tab member that is releasably holding said closure member in the horizontal position.

4. An educational game for children comprising:

(a) a stand;

(b) a hollow container suspended from said stand;

(c) an opening in the bottom of said hollow container;

(d) two closure members pivotally mounted within said opening, said closure members being movable between a horizontal position closing said opening and a vertical position opening said opening;

(e) means for releasably latching said closure member in its horizontal position closing said opening;

(f) means for releasing said latching means to permit said closure member to pivot from its horizontal to its vertical position;

(g) a plurality of game objects of different sizes and shapes having means to divide said objects into different distinguishable sets;

(h) a plurality of distinguishable game boards, each having means to associate that game board with one of the sets and having apertures therein of the same size and shape as the game objects of the associated set; and (i) means for timing the game, whereby each game player may take a game board, the game pieces may be placed in the container, the closure may be closed and subsequently released thereby freeing the game objects to fall therefrom, and the players may race against the timer and each other to place the associated game objects into the matching recesses of their game boards.

5. The game set forth in claim 4 further including:

(j) a plurality of strings attached on one end to said closure member and the other end being free so that the players may pull from said string members to release said closure member.

* * * * *